US005353835A

United States Patent [19]

Mills

[11] Patent Number: 5,353,835

[45] Date of Patent: Oct. 11, 1994

[54] AIR TANK DRAIN

[75] Inventor: Floyd D. Mills, Southern Pines, N.C.

[73] Assignee: Ingersoll-Rand Company, Woodcliff Lake, N.J.

[21] Appl. No.: 126,844

[22] Filed: Sep. 23, 1993

[51] Int. Cl.[5] ..... B65D 25/38

[52] U.S. Cl. ..... 137/590; 137/204

[58] Field of Search ..... 220/DIG. 6; 137/590, 137/204

[56] References Cited

U.S. PATENT DOCUMENTS

| | | | |
|---|---|---|---|
| 2,878,067 | 3/1959 | Grosholz . | |
| 2,939,477 | 6/1960 | Kaldobsky | 137/204 |
| 3,040,991 | 6/1962 | Fedit . | |
| 3,088,680 | 5/1963 | Fulton et al. . | |
| 3,379,373 | 4/1968 | Roberts . | |
| 3,379,379 | 4/1968 | Orem . | |
| 4,294,779 | 10/1981 | Alape . | |
| 4,622,996 | 11/1986 | Gillingham | 137/590 |
| 4,850,517 | 7/1989 | Ter Stege . | |
| 4,890,646 | 1/1990 | Dumser | 137/590 |
| 5,005,601 | 4/1991 | Strong . | |
| 5,148,840 | 9/1992 | Grantham . | |
| 5,188,294 | 2/1993 | Sealy et al. . | |
| 5,195,664 | 3/1993 | Rhea . | |
| 5,211,202 | 5/1993 | Zink et al. . | |

FOREIGN PATENT DOCUMENTS 2031526A 4/1980 United Kingdom .

*Primary Examiner*—Robert G. Nilson

*Attorney, Agent, or Firm*—Walter C. Vliet

[57] ABSTRACT

An automatic air tank drain is provided by forming a venturi induced suction at the tank outlet which draws liquid out of the tank as the tank air is exhausted past the venturi through a flexible hose positioned by a weight at the tank bottom.

9 Claims, 2 Drawing Sheets

AIR TANK DRAIN

BACKGROUND OF THE INVENTION

This invention relates generally to air storage tank drains and more particularly to an automatic venturi drain which expelled accumulated liquid in the tank along with the stored air withdrawn from the tank. Current engine air starter storage tanks utilize a petcock located at the low point of the tank for periodic removal of liquids. Typically this is a maintenance item which is forgotten. Various schemes exist for automatically activating a valve to keep the liquids out of the tank. These are complicated, requiring electric or pneumatic control valves and are, therefore, prone to failures.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing an air tank venturi drain comprising a tank for receiving and storing a compressible pressure fluid; a port means in the tank for delivery of the pressure fluid to a conduit extending from the tank; a suction conduit extending from the port means to a selected point within the tank; and a venturi means formed in the port means for producing suction to educt liquid from the suction conduit and the selected point within the tank.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
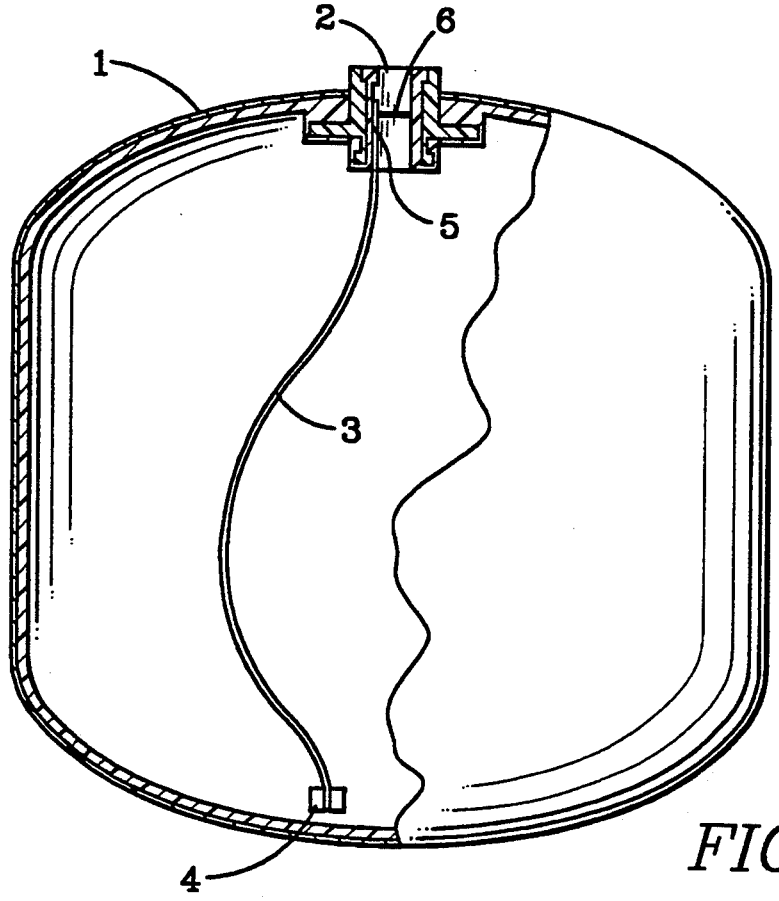
FIG. 1 is a partial sectioned view of a vertically orientated air tank containing a venturi drain according to the present invention.

Referring to FIG. 1, an air tank for a pneumatic engine starter or the like is shown and generally referred to by reference numeral 1. The tank is provided with a port 2 which in the present case is utilized to fill and extract pressure fluid which may, for example, be compressed air or other suitable gas. The tank 1 is further provided with a flexible suction tube 3 extending from the nozzle or port 2 to a low position in the tank where it is open terminated and held in position by a gravity weight 4.

The suction tube 3 is positioned within the nozzle 2 in a groove 5 formed within the interior of the nozzle. The tube or hose 3 is secured within the groove 5 by means of a snap ring 6 or the like (best seen in FIG. 3). The construction shown permits the drain to be readily assembled in the nozzle by simply feeding the flexible conduit into the groove formed in the nozzle and securing it therein by insertion of a snap ring in a groove formed within the nozzle. The open end 10 of the conduit or hose 5 is positioned within the nozzle and formed so as to create a venturi effect as pressure fluid is delivered from the storage tank. The venturi effect creates a suction in the conduit or hose 3 which in turn withdraws any liquid at the bottom of the tank.

Figure 2:
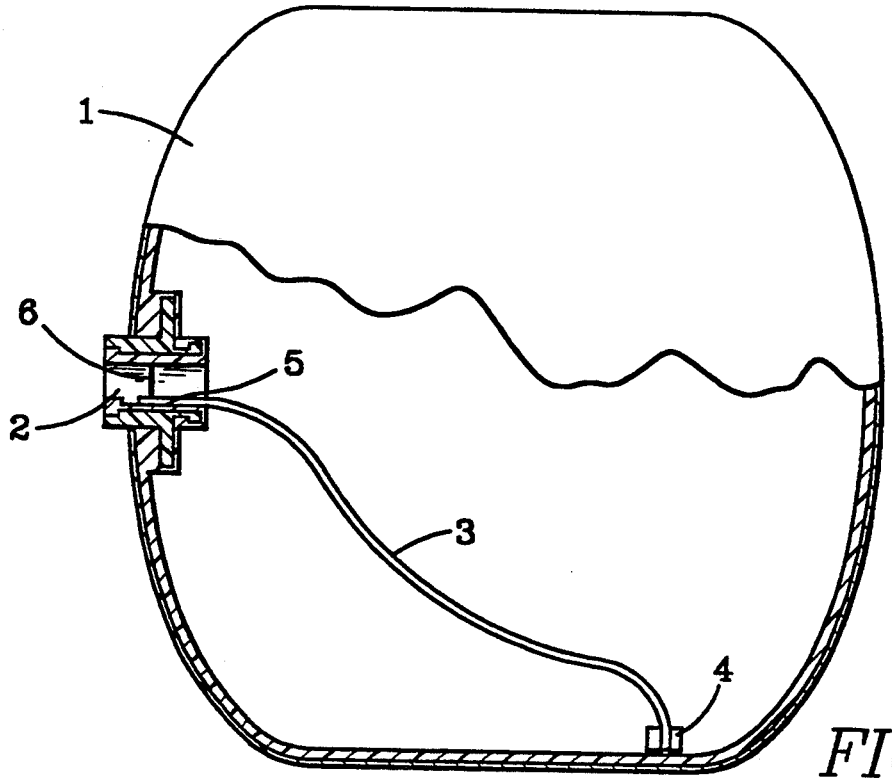
FIG. 2 is a partial sectioned view of an air tank according to the present invention shown in a horizontal position.

The gravity weight 4 is shown attached to the bottom end of the suction tube 3 and is provided for the purpose of assisting the suction tube to find the low portion of the tank in service. This permits the tank to be installed in a vertical position as shown in FIG. 1 or in a horizontal position as shown in FIG. 2. The gravity weight 4 and the suction hose 3 are provided with a notch and bias cuts (of the hose) 11 to permit fluid to be drawn into the suction hose when the gravity weight 4 is on the bottom of the tank.

Figure 3:
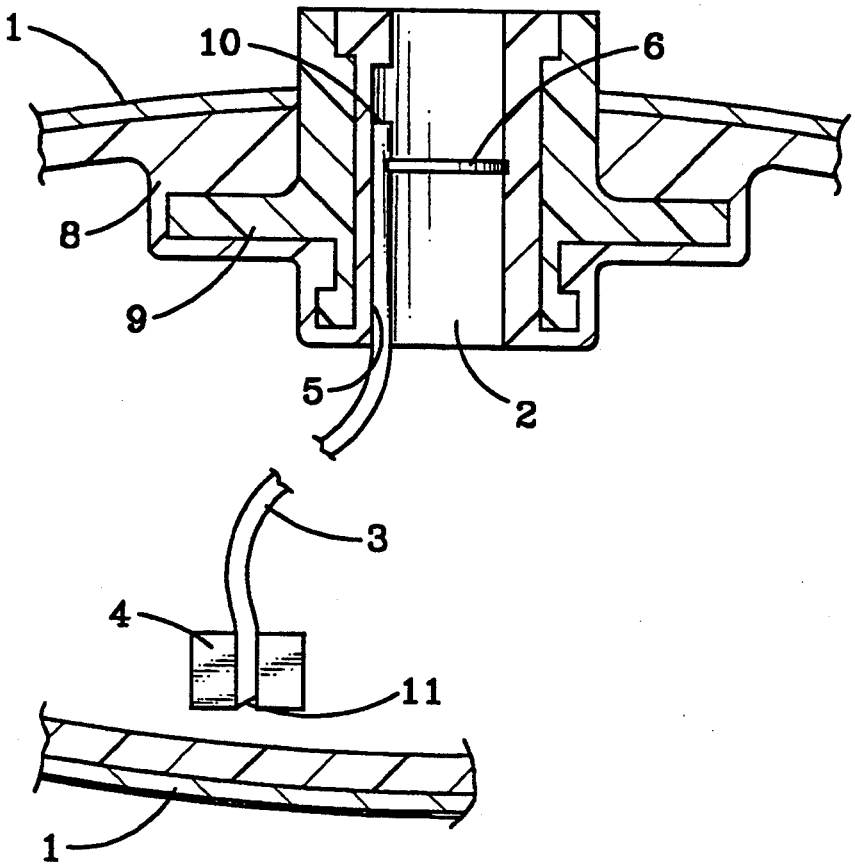
FIG. 3 is a detailed cross section showing the venturi design according to the present invention.

Further, as shown in FIG. 3, the tank may be constructed of a metallic outer shell 1 having a suitable corrosion resistant inner coating 8 of plastic or fiberglass or similar material. A nozzle reinforcement 9 may be utilized and may be made of metal or similar structurally sufficient material to resist the nozzle forces created by the piping connections to the tank.

Thus, it should be now apparent to one skilled in the art that any unwanted liquid in the pressure fluid storage tank will be withdrawn and delivered with the pressure fluid exiting the tank upon withdrawal demand of pressure fluid.

What is claimed is:

1. A tank venturi drain comprising:

a tank for receiving and storing a compressible pressure fluid;

a port means in said tank for delivery of said pressure fluid to a conduit extending from said tank;

a deployable suction conduit extending from said port means to a selected deployed point within said tank;

a venturi means formed in said port means for producing suction to educt liquid from said suction conduit and said selected point within said tank; and said suction conduit being provided with a weight at one end extending to said selected point within said tank to assist its deployment proximit to said selected point and wherein said selected point is the low end of the tank interior.

2. An air tank venturi drain according to claim 1 wherein: said suction conduit is a flexible conduit.

3. A tank venturi drain according to claim 1 wherein: said tank is a pressure storage tank for pneumatic fluid for an air starter for a vehicle.

4. A tank venturi drain comprising:

a tank for receiving and storing a compressible pressure fluid;

a port means in said tank for delivery of said pressure fluid to a conduit extending from said tank;

a deployable suction conduit extending from said port means to a selected deployed point within said tank;

a venturi means formed in said port means for producing suction to educt liquid from said suction conduit and said selected point within said tank; and said venturi means is formed by the placement of said conduit in a milled slot in said port means.

5. A tank venturi drain according to claim 4 wherein: said conduit means further comprises a hose.

6. A tank venturi drain according to claim 5 wherein: said hose is maintained in position in said slot by a snap ring.

7. A venturi drain according to claim 6 wherein: said hose is further provided with a weighted end means for positioning said hose to a low point in said tank.

8. A venturi drain according to claim 7 wherein: said weight and said hose are provided with means for assuring liquid access to said hose.

9. A venturi drain according to claim 8 wherein: said means for assuring liquid access comprises a slot means on said weight and means for positioning said hose slightly away from the bottom of said tank in its operating position.

* * * * *